US010386030B2

(12) United States Patent
Campetella

(10) Patent No.: US 10,386,030 B2
(45) Date of Patent: Aug. 20, 2019

(54) LIGHT FIXTURE, PREFERABLY FOR STAGE

(71) Applicant: CLAY PAKY S.p.A., Seriate (IT)

(72) Inventor: Francesco Campetella, Pesaro (IT)

(73) Assignee: CLAY PAKY S.P.A., Seriate (IT)

( * ) Notice: Subject to any disclaimer, the term of this patent is extended or adjusted under 35 U.S.C. 154(b) by 0 days.

(21) Appl. No.: 15/670,538

(22) Filed: Aug. 7, 2017

(65) Prior Publication Data

US 2018/0045390 A1 Feb. 15, 2018

(30) Foreign Application Priority Data

Aug. 9, 2016 (IT) ..... 10201683994

(51) Int. Cl.

| | |
|---|---|
| ***F21S 10/00*** | (2006.01) |
| ***F21V 9/40*** | (2018.01) |
| *F21V 29/503* | (2015.01) |
| *F21W 131/406* | (2006.01) |
| *H05B 33/08* | (2006.01) |
| *F21Y 115/10* | (2016.01) |

(52) U.S. Cl.

CPC ..... *F21S 10/007* (2013.01); *F21V 9/40* (2018.02); *F21V 29/503* (2015.01); *F21W 2131/406* (2013.01); *F21Y 2115/10* (2016.08); *H05B 33/0857* (2013.01)

(58) Field of Classification Search

None

See application file for complete search history.

(56) References Cited

U.S. PATENT DOCUMENTS

| | | | | |
|---|---|---|---|---|
| 5,188,452 | A | 2/1993 | Ryan | |
| 5,402,326 | A | 3/1995 | Belliveau | |
| 2010/0097802 | A1* | 4/2010 | Jurik | G02B 27/0994 362/235 |
| 2013/0294080 | A1* | 11/2013 | Hansen | F21S 10/00 362/271 |
| 2014/0111999 | A1* | 4/2014 | Quadri | F21S 10/007 362/293 |
| 2016/0208999 | A1 | 7/2016 | Jurik | |

FOREIGN PATENT DOCUMENTS

| | | |
|---|---|---|
| EP | 2 995 852 | 3/2016 |
| GB | 2 307 036 | 5/1997 |

* cited by examiner

*Primary Examiner* — Elmito Breval

(74) *Attorney, Agent, or Firm* — Leason Ellis LLP

(57) ABSTRACT

A light fixture, preferably for stage, includes a source assembly, configured to emit at least one light beam along an emission direction and a mixing assembly arranged downstream of the source assembly along the emission direction and being configured to mix at least one light beam emitted by the source assembly. The light fixture further includes a color assembly comprising at least one color device configured to selectively color the light beam passing through it. The color assembly is arranged between the source assembly and the mixing assembly.

17 Claims, 4 Drawing Sheets

LIGHT FIXTURE, PREFERABLY FOR STAGE

PRIORITY CLAIM

This application claims priority from Italian Patent Application No. 102016000083994 filed on Aug. 9, 2016, the disclosure of which is incorporated by reference.

TECHNICAL FIELD

The present invention relates to a light fixture, preferably to a light fixture for stage.

BACKGROUND OF THE INVENTION

There are known light fixtures for stage, comprising a source assembly, configured to emit one or more light beams, a mixing assembly configured to mix the incoming light beam or beams, and a colour assembly arranged downstream of the mixing assembly and comprising at least one colour filter configured to transmit wavelengths of a specified range in order to colour the light beam exiting the mixing assembly.

An example of a light fixture of this type is described in the document U.S. Pat. No. 5,402,326.

In light fixtures of this type, however, when the colour assembly is activated and the colour filter intercepts the light beam exiting the mixer assembly, the light beam emitted from the light fixture has obvious defects.

In particular, the emitted light beam is not uniformly coloured.

In addition, if the light fixture is provided with at least one gobo and at least one diaphragm, the light fixture emits an even less uniformly coloured light beam when either the gobo or the diaphragm is in focus.

SUMMARY OF THE INVENTION

An objective of the present invention is therefore to provide a light fixture for stage that is free from the drawbacks of the prior art described herein.

In particular, an objective of the present invention is to improve the quality of the coloured light beam and at the same time to ensure that the light fixture manufacturing costs are low and that its size remains substantially unchanged.

In accordance with these objectives, the present invention relates to a light fixture, preferably for stage, comprising:

- a source assembly, configured to emit at least one light beam along an emission direction;
- a mixing assembly arranged downstream of the source assembly along the emission direction and configured to mix one or more light beams emitted by the source assembly;
- a colour assembly comprising at least one colour device configured to selectively colour the light beam passing through it; the colour assembly being arranged between the source assembly and the mixing assembly.

Thanks to the fact that the colour assembly is arranged between the source assembly and the mixing assembly, the colouration of the projected beam is uniform and free from defects.

BRIEF DESCRIPTION OF THE DRAWINGS

Further characteristics and advantages of the present invention will become apparent from the following description of a non-limiting example of an embodiment, with reference to the figures of the accompanying drawings, wherein.

DETAILED DESCRIPTION OF THE INVENTION

Figure 1:
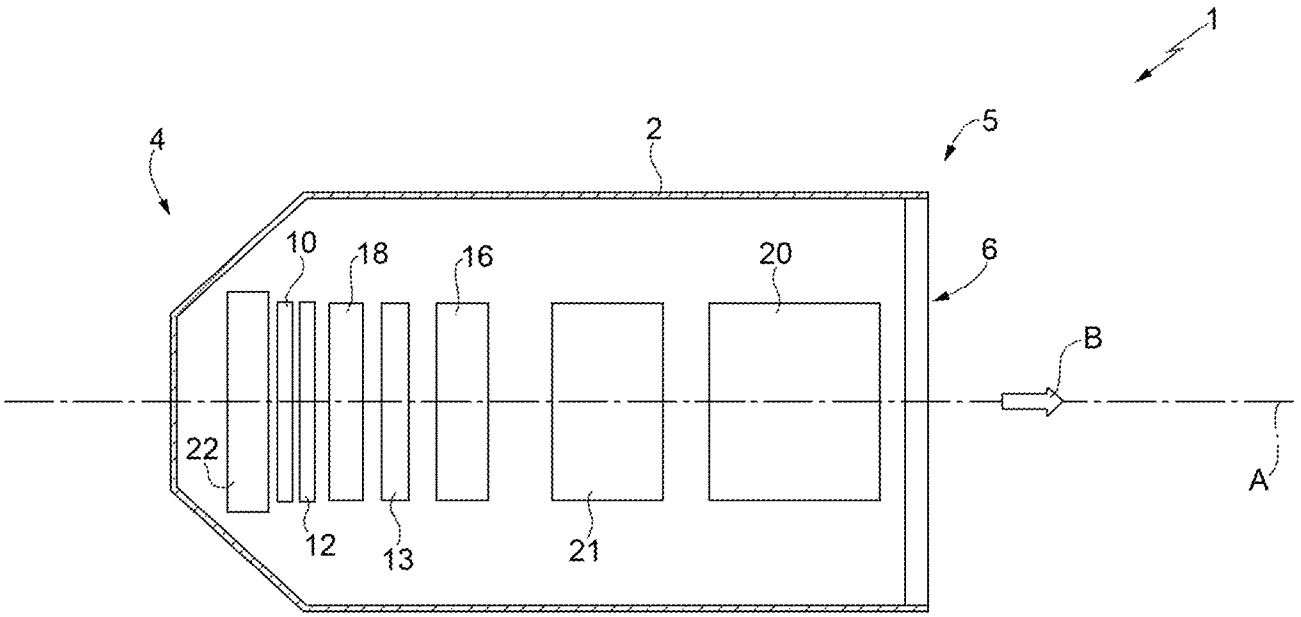
FIG. 1 is a schematic side-view diagram, with parts in section and parts removed for clarity, of the light fixture of the present invention.

In FIG. 1, a light fixture, preferably for stage, is indicated with the reference number 1.

In FIG. 1, a light fixture comprising a casing 2 and support means (not shown in the attached figures) configured to support the casing 2 is indicated with the reference number 1.

The support means are preferably configured to move the casing 2 and to allow the casing 2 to rotate around two orthogonal axes, commonly termed PAN and TILT. The operation of the support means is controlled by a motion control device (not shown in the attached figures). The motion control device can also be managed remotely, preferably via communications using the DMX protocol.

According to a variant, the support means may be configured to support only the casing 2 without allowing the motion.

The casing 2 extends along a longitudinal axis A and is provided with a first closed end 4 and a second end 5, opposite to the first closed end 4 along the axis A, and provided with a light opening 6. In the non-limiting example described and illustrated herein, the light opening 6 has a substantially circular cross-section. The light opening 6 is preferably centred on the axis A of the casing 2.

Figure 2:
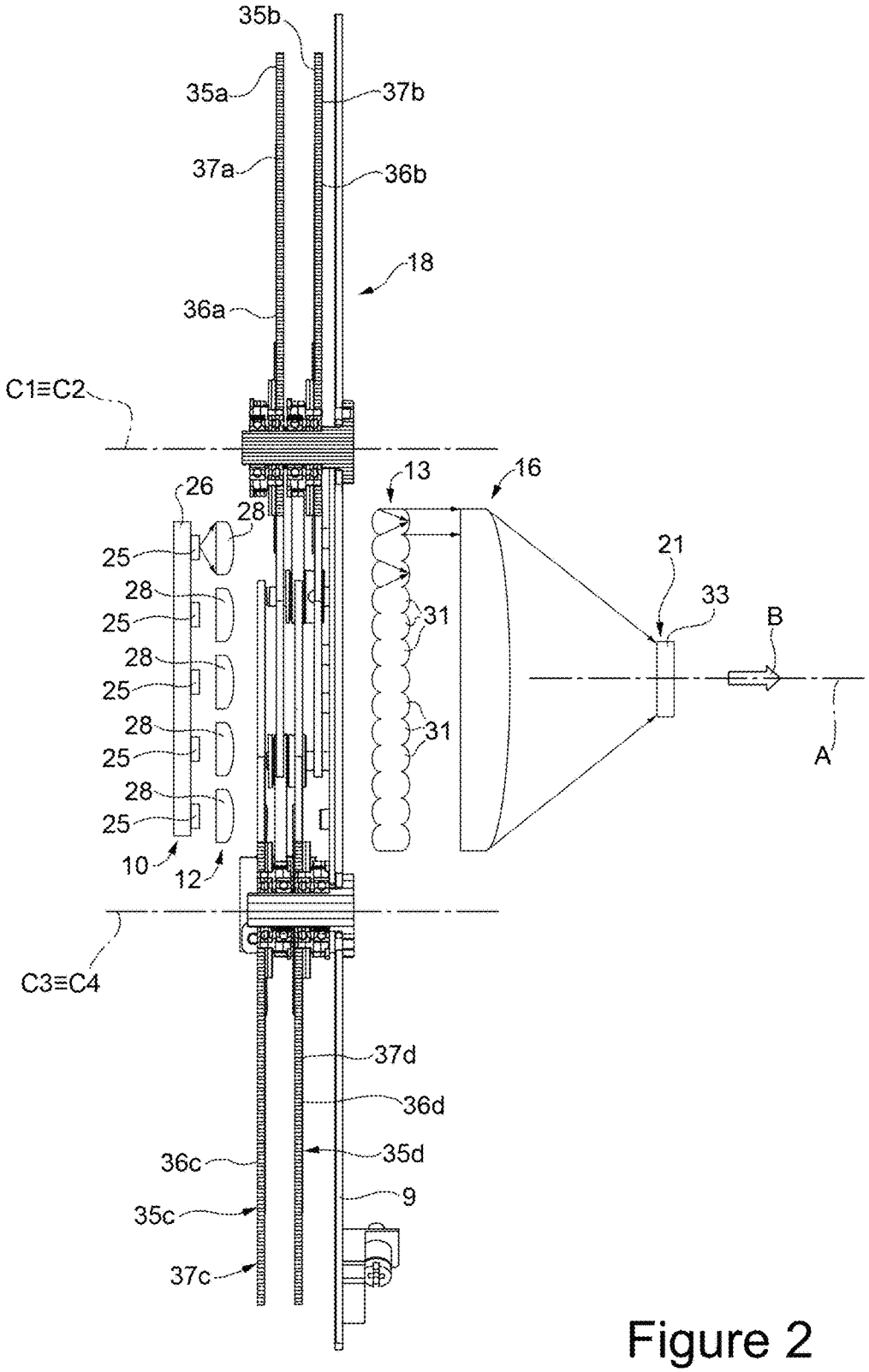
FIG. 2 is a rear schematic view, with parts removed for clarity, of a detail of FIG. 1.

The light fixture 1 also comprises a frame 9 coupled to the casing 2 (only a portion of which is shown in FIG. 2), a source assembly 10, a collimator assembly 12, a mixing assembly 13, a condenser assembly 16, a colour assembly 18, an optical assembly 20 (shown schematically in FIG. 2), a light beam processing assembly 21 (shown schematically in FIG. 2) and a cooling assembly 22.

The frame 9 is integral with the casing 2 and comprises a plurality of components coupled together and configured to define a support structure for the components arranged inside the casing 2, including the source assembly 10, the collimator assembly 12, the mixing assembly 13, the condenser assembly 16, the colour assembly 18, the optical assembly 20, the light beam processing assembly 21, and the cooling assembly 22.

The source assembly 10 is arranged inside the casing 2 at the closed end 4 of the casing 2, is supported by the frame 9, and is suitable to emit one or more light beams mainly along an emission direction B.

Emission direction means the direction towards which the greatest amount of the light beam emitted by the source or sources of the source assembly 10 propagates. If the source assembly 10 comprises multiple light sources, the emission direction is determined by considering the main axis of the sum of the light beams emitted from the light sources. With reference to FIG. 2, in the non-limiting example described and shown herein, the source assembly 10 comprises a plurality of light sources 25 (partially shown in FIG. 2), preferably LEDs, and a supporting plate 26 configured to support the light sources 25.

The light sources 25 are preferably uniformly distributed along the supporting plate 26 in such a way as to generate a plurality of uniformly distributed light beams.

The light sources 25 are preferably arranged in the same plane and are substantially arranged as a matrix. In other words, the light sources 25 are arranged along horizontal rows and vertical columns.

The matrix of light sources 25 is preferably centred on the axis A of the casing 2.

In the non-limiting example described and shown herein the LEDs that define the light sources 25 are white.

A variant not shown envisages that the light sources 25 are LEDs of the RGB (Red Green Blue) type and that each RGB LED is provided with a mixing device of the electronic type, configured for mixing the three colours (i.e. red, green and blue) to obtain the desired colour.

A further variant not shown envisages that the light sources 25 are sources of the LARP (Laser Activated Remote Phosphor) type. For example, the LARP type light sources may comprise a blue laser diode coupled to a yellow phosphorus to obtain a white light. Alternatively, the LARP type sources may also comprise laser diodes of different colour (red, green or blue). The collimator assembly 12 is configured to straighten the incoming beam or beams.

In particular, in the case of a source assembly 10 comprising a plurality of light sources 25, the collimator assembly 12 comprises a plurality of lenses 28, each of which is configured to straighten a respective beam emitted from a respective light source 25. In this case, the plurality of lenses 28 is arranged downstream of the source assembly 10 along the emission direction B.

The lenses 28 are preferably attached to a supporting frame (not shown in the accompanying figures) and arranged in the same plane.

The distance between the light sources 25 and the lenses 28 is defined in such a way that each light source 25 is located at the focus of the respective lens 28. The rays emitted by the light source 25 will thus be refracted parallel to the optical axis of the lens 28. In other words, the light beam is collimated.

If the source assembly 10 comprises a single light source, such as for example a discharge lamp, the collimator assembly 12 comprises a reflector, preferably parabolic, coupled to the light source and configured in such a way as to transform the light beam emitted by the light source into a beam of substantially parallel light rays. In this case, the collimator assembly 12 is not arranged downstream of the source 12.

The mixing assembly 13 is arranged downstream of the collimator assembly 12 along the emission direction B of the beam and is configured in such a way as to mix the rays of the incoming light beam or beams so as to generate a homogeneous mixed light beam.

In the non-limiting example described and shown herein in which the source assembly 10 comprises a plurality of light sources 25, the mixing assembly 13 comprises an optical mixing element 30, known in the jargon of the field as a "fly's eyes optical element".

The optical mixing element 30 comprises a plurality of square or hexagonal lenses 31 arranged side by side so as to form a matrix.

Each lens 31 projects an image proportional to its own shape. The overlapping of the projected images determines the mixing of the beam or beams of the source assembly 10.

The optical mixing element 30 is preferably a monolithic element.

A variant not shown envisages that the mixing unit comprises a mixing element defined by a plurality of mixing devices arranged side by side and substantially aligned with the respective light sources 25. Each mixing device has a substantially elongated prismatic shape and extends along the optical axis of the light beam of the source with which it is associated. Each mixing device thus collects part of the light beam emitted by the light sources 25 and mixes it appropriately so as to generate a respective mixed and homogeneous light beam.

With reference to FIG. 1, the condenser assembly 16 is arranged downstream of the mixing assembly 13 along the emission direction B of the beam and comprises one or more optical elements arranged and configured in such a way that the incoming beam is concentrated in the desired manner.

With reference to FIG. 2, in the non-limiting example described and shown herein, the condenser assembly 16 comprises a lens 32 configured to concentrate the beam at a processing element 33 (schematically represented in the attached figures) of the light beam processing assembly 21.

For example, the condenser assembly 16 is configured to concentrate the beam at a gobo disk, or at a diaphragm or other elements of the light beam processing assembly 21.

In the non-limiting example described and shown herein, the lens 32 is a plano-convex lens.

A variant not shown envisages that the condenser assembly 16 is defined by an assembly of coupled lenses.

With reference to FIG. 1, the colour assembly 18 is arranged downstream of the mixing assembly 13 and upstream of the condenser assembly 16 along the emission direction B of the light beam.

The colour assembly 18 comprises at least one colour device 35 configured to selectively colour the incident light beam.

In the non-limiting example described and shown herein, the colour assembly 18 comprises four different colour devices 35*a*, 35*b*, 35*c*, 35*d*.

In particular, each colour device 35*a*, 35*b*, 35*c*, 35*d* comprises one or more filters having specific characteristics. The colour devices 35*a*, 35*b*, 35*c*, 35*d* thus differ by the filtering characteristics of the filters contained in them.

Figure 3:
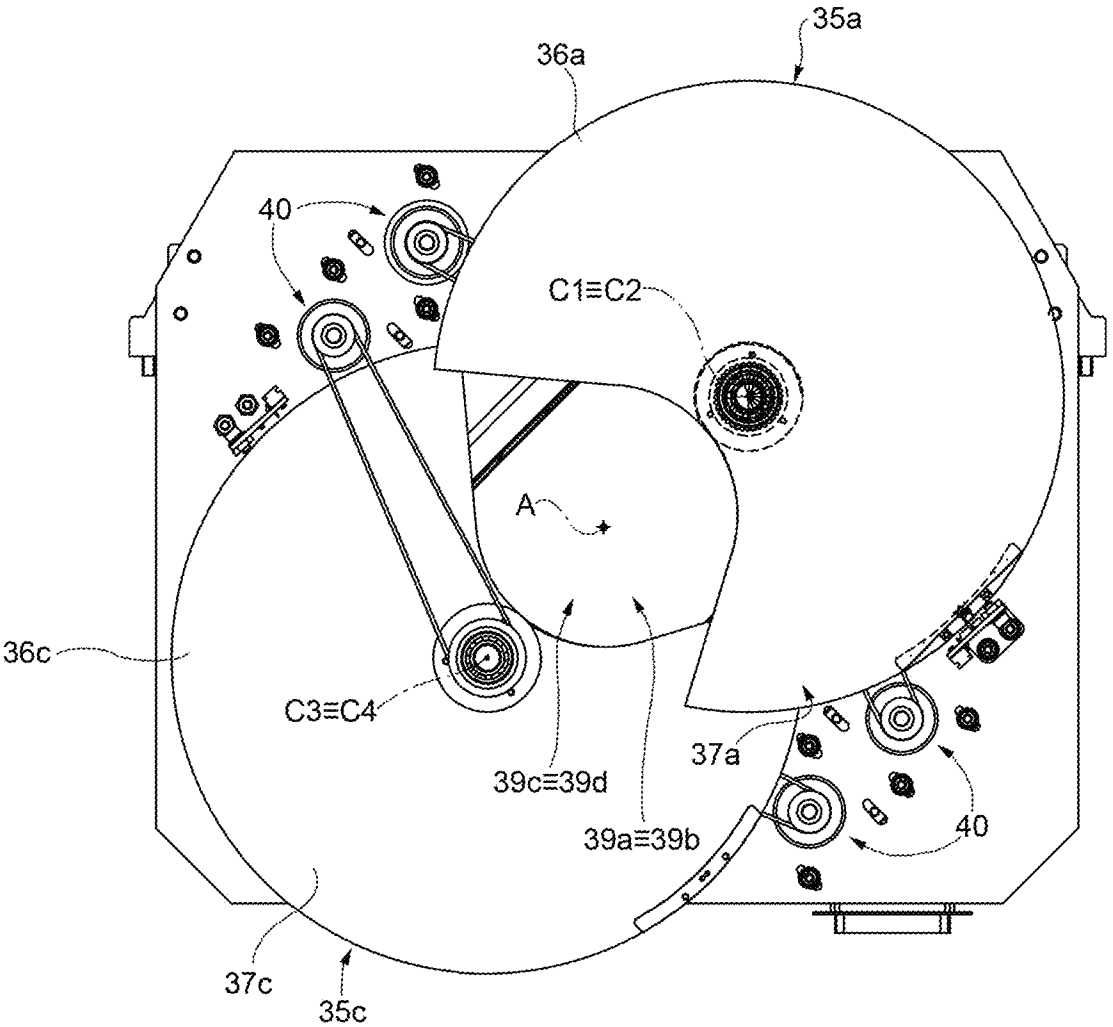
FIG. 3 is a schematic view, with parts removed for clarity, of a variant of the detail of FIG. 2.

With reference to FIG. 2 and FIG. 3, the first colour device 18*a* comprises a first disk 36*a* which can rotate about a first axis C1 and provided with at least one filter 37*a*. In the non-limiting example described and shown herein the filter 37*a* is a magenta filter. The first disk 36*a* is preferably provided with a portion 39*a* that does not cause a colour change. The portion 39*a* is preferably transparent.

In the non-limiting example described and shown herein, the transparent portion 39*a* is defined by a recess formed in the first disk 36*a*.

The filter 37*a* is preferably a colour fading filter configured to transmit light radiation so as to generate a colour progression from 10% to 100%.

The second colour device 18*b* comprises a second disk 36*b* which can rotate about a second axis C2 and provided with at least one filter 37*b*. The second axis C2 is preferably coincident with the first axis C1.

In the non-limiting example described and shown herein the filter 37*b* is a yellow filter.

The second disk 36*b* is preferably provided with a portion 39*b* that does not cause a colour change. The portion 39*b* is preferably transparent. In the non-limiting example described and shown herein in FIG. 3, the transparent portion 39*b* is coincident with the portion 39*a* of the disk 36*a*, since the first disk 36*a* and the second disk 36*b* are superimposed.

In the non-limiting example described and shown herein, the transparent portion 39*b* is defined by a recess formed in the second disk 36*b*.

The filter 37*b* is preferably a colour fading filter configured to transmit light radiation so as to generate a colour progression from 10% to 100%.

The third colour device 18*c* comprises a third disk 36*c* which can rotate about a third axis C3 and provided with at least one filter 37*c*. The second axis C2 and the third axis C3 are preferably parallel.

In the non-limiting example described and shown herein the filter 37*c* is a cyan filter.

The third disk 36*c* is preferably provided with a portion 39*c* that does not cause a colour change. The portion 39*c* is preferably transparent.

In the non-limiting example described and shown herein, the transparent portion 39*c* is defined by a recess formed in the third disk 36*c*.

The filter 37*c* is preferably a colour fading filter configured to transmit light radiation so as to generate a colour progression from 10% to 100%.

The fourth colour device 18*d* comprises a fourth disk 36*d* which can rotate about a fourth axis C4 and provided with at least one filter 37*d*. The fourth axis C4 is preferably coincident with the third axis C3.

In the non-limiting example described and shown herein the filter 37*d* is a CTO ("colour temperature orange") filter, i.e. a filter that moves the colour temperature from white towards lower colour temperatures, for example from approximately 6000 K to approximately 3000 K.

The fourth disk 36*d* is preferably provided with a portion 39*d* that does not cause a colour change. The portion 39*d* is preferably transparent. In the non-limiting example described and shown herein in FIG. 3, the transparent portion 39*d* is coincident with the portion 39*c* of the disk 36*c*, since the disk 36*c* and the disk 36*d* are superimposed.

In the non-limiting example described and shown herein, the transparent portion 39*d* is defined by a recess formed in the fourth disk 36*d*.

In use, the colour devices 35*a*, 35*b*, 35*c*, 35*d* are rotated appropriately so that the beam intersects one or more filters in a particular position.

In FIG. 3, the light beam does not intercept any of the colour filters because the colour devices 35*a*, 35*b*, 35*c*, 35*d* are rotated so that the transparent portions are aligned with the light beam.

The first disk 36*a*, the second disk 36*b*, the third disk 36*c*, and the fourth disk 36*d* are moved by respective motors (not shown in the attached figures). The motors independently move the first disk 36*a*, the second disk 36*b*, the third disk 36*c*, and the fourth disk 36*d* by means of belt drive systems 40 (partially shown in FIG. 3) based on commands from the control system (not shown).

Figure 4:
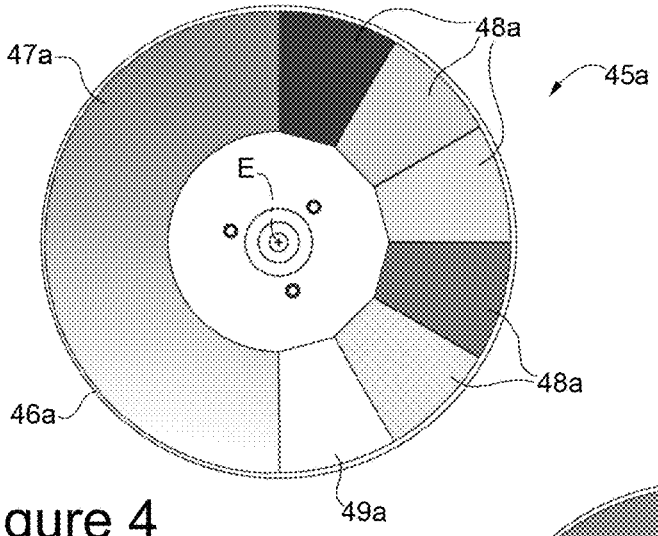
FIGS. 4, 5, 6 are front views, with parts removed for clarity, of details of a light fixture according to a variant of the present invention.
Figure 5:
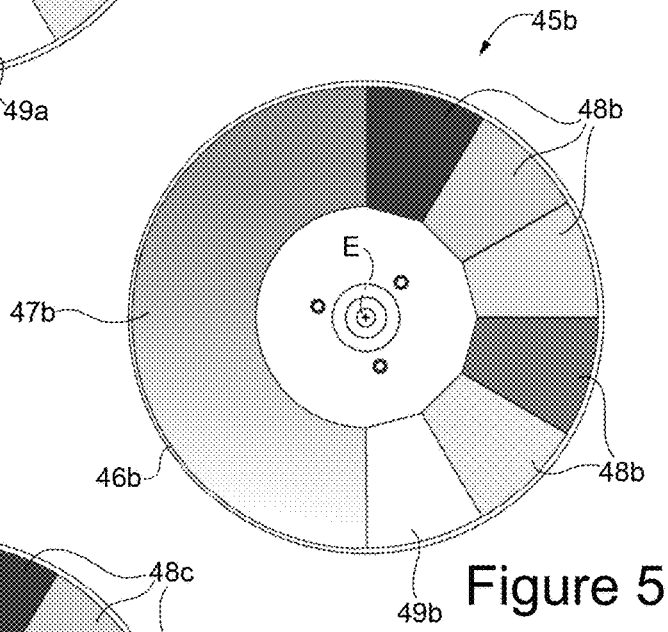
Figure 6:
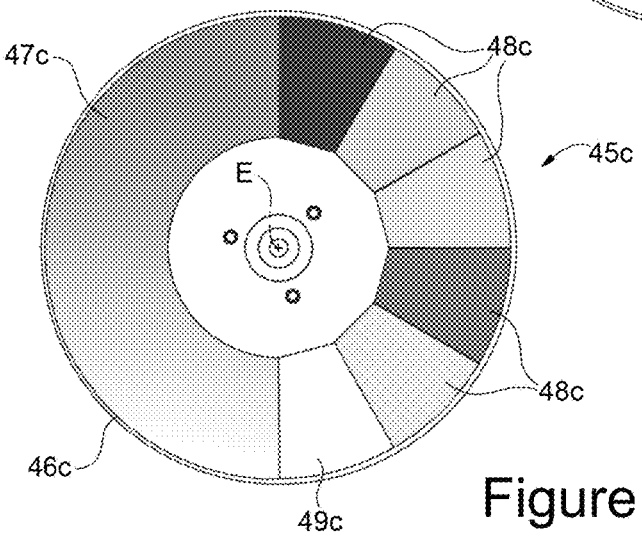

A variant shown in FIGS. 4-6 envisages that the colour assembly 18 comprises only three colour devices 45*a*, 45*b*, 45*c*.

Each colour device 45*a*, 45*b*, 45*c* comprises a respective disk 46*a*, 46*b*, 46*c*.

The disks can be rotated about a common axis E which is not coincident with the axis A of the casing 2.

Each disk 46*a*, 46*b*, 46*c* is provided with a first colour fading filter 47*a*, 47*b*, 47*c*, at least one transparent portion 49*a*, 49*b*, 49*c*, and at least one second filter 48*a*, 48*b*, 48*c* selected from the group comprising: a hot filter configured to reduce the colour temperature of the transiting light beam, a cold filter configured to increase the colour temperature of the transiting light beam, a Wood filter, a diffusing filter configured to diffuse the transiting light beam, a holographic filter, and a colour filter configured to block predefined wavelengths so as to colour the transiting light beam.

The first colour fading filter 47*a*, 47*b*, 47*c* is preferably defined by an annular filter portion configured to provide a fading effect during the rotation of the respective colour device 45*a*, 45*b*, 45*c*.

In other words, the annular filter portion is configured to regulate a progressive change of the colour of the beam passing through it during rotation of the respective colour device 45*a*, 45*b*, 45*c*.

A variant not shown in the figures provides that the portion of the annular filter is replaced by a plurality of colour filters arranged consecutively and configured to regulate a progressive change of the colour of the beam passing through it during rotation of the respective colour device 45*a*, 45*b*, 45*c*.

In the non-limiting example described and shown herein, the colour device 45*a* comprises an annular filter portion 47*a* which can create a progression of the magenta colour, the colour device 45*b* comprises an annular filter portion 47*b* which can create a progression of the yellow colour, and the colour device 47*c* comprises an annular filter portion 47*c* which can create a progression of the cyan colour.

Similarly to the descriptions of the embodiment of FIGS. 1-3, thanks to the particular structure of the annular portion of the filter 47*a*, 47*b*, 47*c*, during rotation of the colour device 45*a*, 45*b*, 45*c* around its own axis of rotation E, it is possible to gradually change the colour of the projected beam from a light colour to a darker colour and vice versa, depending on the direction of rotation of the respective colour device 45*a*, 45*b*, 45*c*.

The first colour fading filters 47*a*, 47*b*, 47*c*, are preferably obtained by means of the removal of layers of dielectric material deposited on a layer of glass. The removal of the layers is preferably carried out by a laser technique.

If the light sources 25 are RGB LEDs, the colour assembly has the function of improving and regulating the colour hue obtained from the light source 25. In addition, thanks to the presence of the mixer 13 downstream of the colour assembly 18, there is also an improvement in terms of colour uniformity of the beam.

With reference to FIG. 1, the optical assembly 20 is arranged at the open end 5 of the casing 2 so as to be centred on the axis A and close off the casing 2.

The optical assembly 20 is an optical output assembly, arranged at the point furthest downstream along the axis A, so as to be the last assembly able to process the intercepted light beam.

The optical assembly 20 has a focal point PF arranged between the source assembly 10 and the optical assembly 20.

The optical assembly 20 comprises one or more lenses (not shown in the attached figures) arranged and configured in such a way that the optical assembly 20 has a positive refractive power. The optical assembly 20 can preferably move along the axis A to adjust the focus of the projected image. In particular, the optical assembly 20 can move along the axis A between a first operating position and a second operating position.

The optical assembly 20 preferably comprises a support frame which is coupled to a trolley which can move along the axis A (not shown for the sake of simplicity), the movement of which is regulated by an autofocus device (known and not shown).

The light beam processing assembly 21 comprises a plurality of light beam processing elements supported by the frame 9 and configured to process the light beam generated by the source assembly 10 so as to obtain special effects. In particular, the light beam processing elements are supported and/or configured to selectively intercept the light beam to modify the light beam only when necessary. In other words, the light beam processing elements can intercept the beam to modify its properties only when necessary.

The position of each of the light beam processing elements is regulated by a control device for the light beam processing means (not visible in the attached figures). The control device for the light beam processing elements can also be managed remotely, preferably via communications using the DMX protocol.

The light beam processing assembly 21 comprises, preferably in sequence, a first gobo device, a rainbow device, a second gobo device, a frost assembly, and a prismatic element.

It is understood that the light beam processing assembly 21 can comprise further light beam processing elements not listed herein.

The cooling assembly 22 comprises at least one cooling module arranged close to the source assembly 10.

In particular, the cooling module is a heat exchanger defined by a plurality of heat exchange ducts fed with air.

The cooling module is preferably coupled to the supporting plate 26 of the plurality of light sources 25.

A variant envisages that the cooling assembly 22 comprises one or more cooling fans.

Beneficially, thanks to the positioning of the colour assembly 18 between the source assembly 10 and the mixing assembly 13, the quality of the coloured light beam projected is optimised.

Irrespective of which light beam processing element 33 is in focus, the projected light beam has a uniform colouring.

Finally, it is apparent that the light fixture for stage described herein may be subject to modifications and variations without departing from the scope of the appended claims.

The invention claimed is:

1. A light fixture, preferably for stage, comprising:

a source assembly (10), configured to emit at least one light beam along an emission direction (D);

a mixing assembly (13) arranged downstream of the source assembly (10) along the emission direction (D) and configured to mix at least one light beam emitted by the source assembly (10), wherein the mixing assembly (13) comprises a plurality of lenses arranged side-by-side so as to form an array of lenses;

a colour assembly (18) comprising at least one colour device (45*a*, 45*b*, 45*c*) configured to selectively colour the light beam passing through it; the colour assembly (18) being arranged between the source assembly (10) and the mixing assembly (13); and a collimator assembly (12) associated with the source assembly (10) and configured to straighten at least one incoming light beam, the collimator assembly (12) comprising an array of lenses (28) that are arranged between the mixing assembly (13) and the source assembly (10).

2. The light fixture according to claim 1, wherein the colour assembly (18) comprises a plurality of colour devices (45*a*, 45*b*, 45*c*, 45*d*; 45*a*, 45*b*, 45*c*) configured to selectively colour the light beam passing through them.

3. The light fixture according to claim 1, wherein the colour device (45*a*, 45*b*, 45*c*, 45*d*; 45*a*, 45*b*, 45*c*) comprises at least one first filter (37*a*, 37*b*, 37*c*, 37*d*; 47*a*, 47*b*, 47*c*) configured to transmit light radiation having wavelengths comprised in at least one first respective band.

4. The light fixture according to claim 3, wherein each colour device (45*a*, 45*b*, 45*c*, 45*d*; 45*a*, 45*b*, 45*c*) is rotatable about a respective axis of rotation (C1, C2, C3, C4).

5. The light fixture according to claim 4, wherein the first filter (37*a*, 37*b*, 37*c*, 37*d*; 47*a*, 47*b*, 47*c*) is configured to create a progressive change of colour in the beam passing through it during the rotation of the respective colour device.

6. The light fixture according to claim 3, wherein the colour device (45*a*, 45*b*, 45*c*, 45*d*; 45*a*, 45*b*, 45*c*) comprises at least one non colour changing portion (49*a*, 49*b*, 49*c*).

7. The light fixture according to claim 3, wherein the colour device (45*a*, 45*b*, 45*c*, 45*d*; 45*a*, 45*b*, 45*c*) comprises at least one second filter (48*a*, 48*b*, 48*c*) selected from the group comprising: a hot filter configured to reduce the colour temperature of the transiting light beam, a cold filter configured to increase the colour temperature of the transiting light beam, a Wood filter, a diffusing filter configured to diffuse the transiting light beam, a holographic filter, and a colour filter configured to block predefined wavelengths so as to colour the transiting light beam.

8. The light fixture according to claim 6, wherein the at least one non colour changing portion (49*a*, 49*b*, 49*c*) comprises a recess that is open along a peripheral outer edge of the respective colour device (45*a*, 45*b*, 45*c*, 45*d*; 45*a*, 45*b*, 45*c*).

9. The light fixture according to claim 1, comprising a condenser assembly (16) arranged downstream of the mixing assembly (13) along the emission direction (D) and configured to concentrate at least one entering light beam.

10. The light fixture according to claim 1, wherein the source assembly (10) comprises a single light source.

11. The light fixture according to claim 10, comprising a parabolic reflector associated with the light source.

12. The light fixture according to claim 1, wherein the source assembly (10) comprises a plurality of light sources (25).

13. The light fixture according to claim 12, wherein the plurality of light sources (25) is arranged in the same plane.

14. The light fixture according to claim 12, wherein the light sources of the plurality of light sources (25) are LED or LARP light sources.

15. The light fixture according to claim 1, wherein the plurality of lenses of the mixing assembly (13) each has a shape selected from the group consisting of square and hexagonal.

16. The light fixture according to claim 1, wherein the plurality of lenses define a monolithic element.

17. The light fixture according to claim 1, wherein each lens of the plurality of lenses projects an image proportional to a shape of the lens and overlapping of the projected images determines mixing of the at least one light beam.

* * * * *